United States Patent [19]

Barry

[11] Patent Number: 4,787,540

[45] Date of Patent: Nov. 29, 1988

[54] HAND GUN HOLSTER SELECTABLY CONFIGURED AND TO BE PLACED ON A BELT

[76] Inventor: John C. Barry, 21521 73rd Pl. W., Unit 3, Edmonds, Wash. 98020

[21] Appl. No.: 946,971

[22] Filed: Dec. 29, 1986

[51] Int. Cl.[4] ..... F41C 33/02

[52] U.S. Cl. ..... 224/192; 224/193; 224/250; 224/253; 224/911

[58] Field of Search ..... 224/192, 232, 250, 251, 224/253, 901, 904, 911, 912, 193

[56] References Cited

U.S. PATENT DOCUMENTS 4,341,331 7/1982 McDougall ..... 224/901 X
4,544,089 10/1985 Tabler ..... 224/192
4,644,676 2/1987 Stern ..... 224/911 X

*Primary Examiner*—Henry J. Recla
*Attorney, Agent, or Firm*—Roy E. Mattern, Jr.

[57] ABSTRACT

A hand gun holster to operationally hold a thirty eight revolver, an automatic pistol or another hand gun, has a pair of belt loops made of polypropylene medium weight webbing in turn positioned and supported by a pair of curvable assemblies of heavy weight nylon webbing having sewn thereon respectively and cooperatively spaced heavy duty nap, i.e. loop, and hook fastening materials, with these pair of curvable assemblies being arranged in alignment to receive and to hold an automatic pistol, and being arranged perpendicularly to receive and to hold a thirty eight revolver.

6 Claims, 2 Drawing Sheets

HAND GUN HOLSTER SELECTABLY CONFIGURED AND TO BE PLACED ON A BELT

CROSS REFERENCE

In copending application Ser. No. 06/913706 a hand gun holster is disclosed made of comparable and like webbing materials, and nap, i.e. loop, and hook fastening materials.

BACKGROUND OF THE INVENTION

Except for the hand gun holster disclosed in the copening application Ser. No. 06/913706, no other hand gun holsters are known which are made of these heavy duty materials: nylon heavy weight webbing; polypropylene medium weight webbing; and respective nap and hook materials. Moreover, no hand gun holsters made of these materials or any other materials are known, which are selectably configured, on the spot, in one arrangement to receive a thirty eight revolver and in another arrangement to receive an automatic pistol.

SUMMARY OF THE INVENTION

To reduce the weight and bulk of holsters for hand guns and to decrease their profile for better concealment within coats and jackets, and yet maintain both quick draw capabilities of a revolver from a holster and the secure carrying of a revolver, this selectably configured and selectably placed on a belt, hand gun holster, is provided. Two belt loops made of polypropylene medium weight webbing are preferably made available, so the holster may be supported on either a person's left or right side, and/or arranged to hold a hand gun on the outside or inside of a person's trousers.

These belt loops are positioned and supported by a pair of curvable assemblies of heavy weight nylon webbing, having sewn thereon respectively and cooperatively spaced heavy duty nap, i.e. loop, and hook fastening materials. This pair of curvable assemblies are aligned and selectively overlapped and secured by selective portions of the nap and hook fastening materials to receive and to hold an automatic pistol. Or this pair of curvable assemblies are arranged perpendicularly and selectively overlapped and secured by selective portions of the nap and hook fastening materials to receive and to hold a thirty eight revolver.

DRAWINGS

The hand gun holster which is selectably configured and placed on a belt is illustrated in the drawings wherein.

DESCRIPTION OF THE PREFERRED EMBODIMENTS

Figure 1:
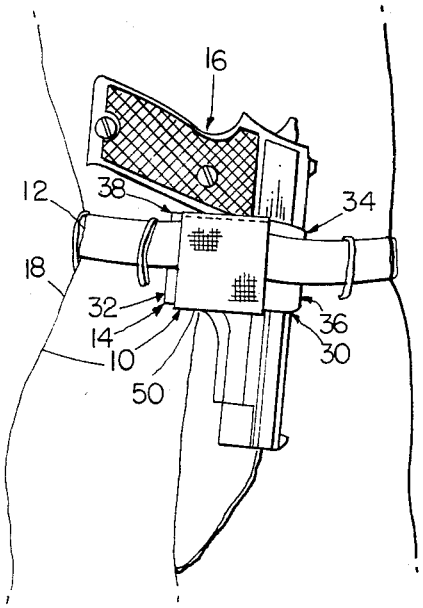
FIG. 1 is a partial side view of a person wearing a belt, which has been passed through the belt loop of the holster, and the holster is arranged in its aligned configuration to receive an automatic pistol placed outside of the person's trousers.
Figure 2:
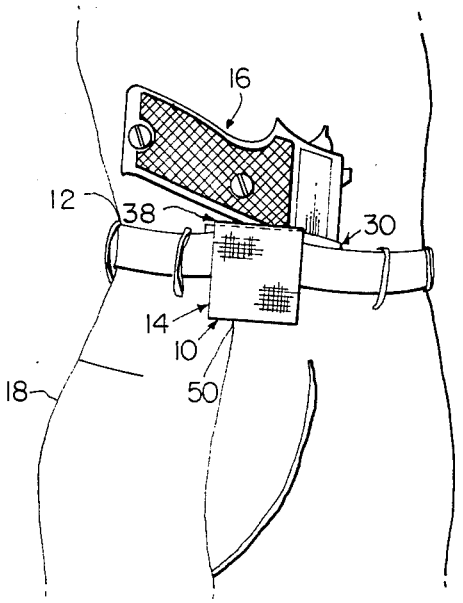
FIG. 2 is a partial side view very similar to the view of FIG. 1; however, the other belt loop is being used and the automatic pistol is placed inside of the person's trousers.
Figure 5:
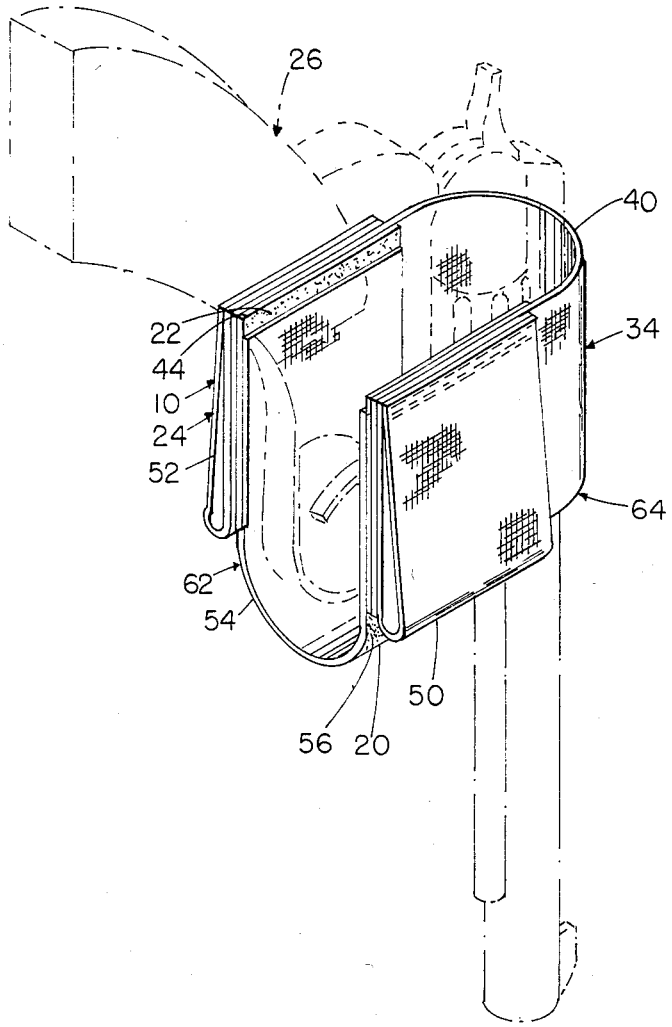
FIG. 5 is a perspective rear corner view of the holster arranged in its perpendicular configuration to receive a thirty eight revolver which is shown in phantom lines.

This hand gun holster 10 is supported on a person's belt 12 in an aligned configuration 14, to receive an automatic pistol 16 positioned either outside or inside a person's trousers 18, as illustrated respectively in FIGS. 1 and 2. Or the hand gun holster 10 is rearranged conveniently, by using the nap 20 and hook 22 fastener materials, into a perpendicular configuration 24, to receive a thirty eight revolver 26, as shown in FIG. 5.

The Alignment Configuration

Figure 3:
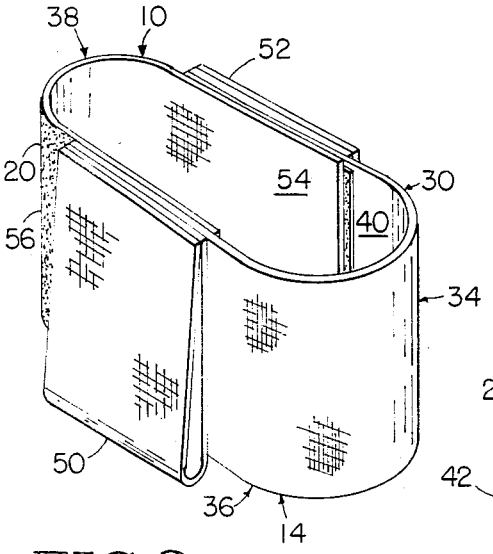
FIG. 3 is a perspective view of the assembled aligned configuration of this hand gun holster.

The assembled hand gun holster 10, in the aligned configuration 14 is shown in FIG. 3. The various starting materials are illustrated in the exploded view of FIG. 4. One, 30, of the pair of curvable assemblies 30, 32, is considered as being the front portion 34 of the main body 36 of the holster 10. The other, 32, of the pair of curvable assemblies 30, 32, is considered as being the rear portion 38 of the main body 36 of the holster 10. Also the rear portion 38 is referred to as the adjustable portion 38, or the adjuster 38. By using selected overlapped positions of the overlapping rear 38 portion and the front portion 34, the size of the main body 36 is adjusted to complementary fit various hand guns.

Figure 4:
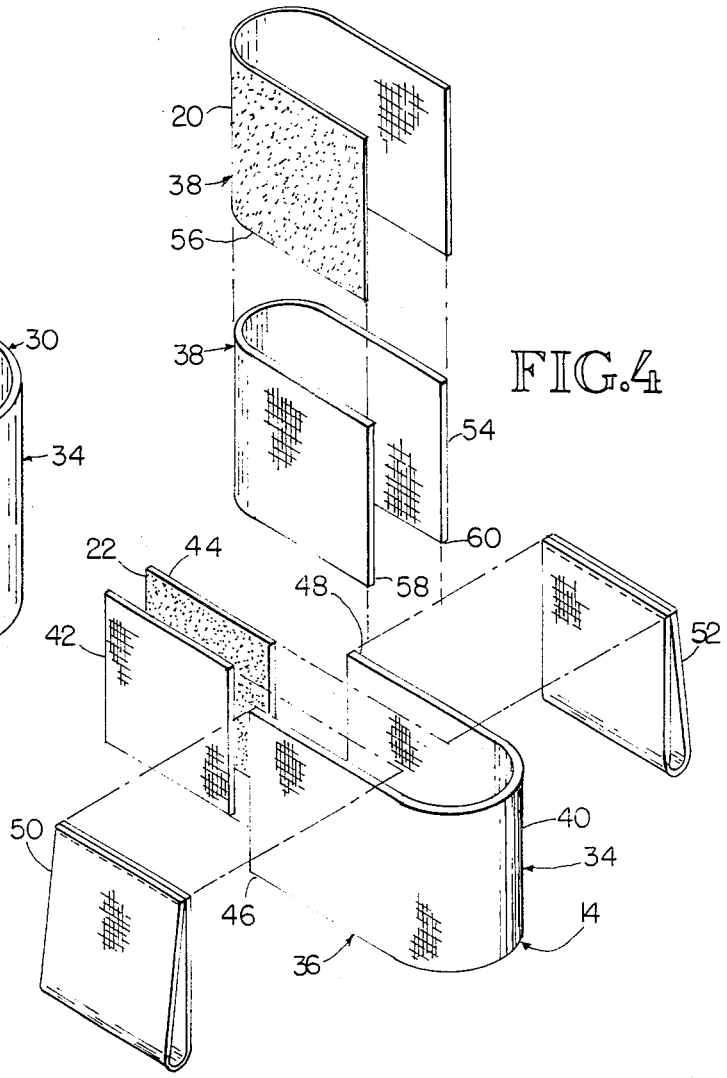
FIG. 4 is a perspective exploded view of all of the respective materials cut, curved and/or looped, before they are either sewn together and/or fastened together using the nap, i.e. loop, and hook fasteners.

In respect to a specific embodiment made as shown in FIG. 4, the front portion 34 of the main body 36 is made by cutting one seven inch long piece 40 from a two inch wide strip of heavy weight nylon webbing. The cut ends are singed. Then two pieces 42, 44 two inches long are cut from a two inch wide strip of heavy duty hook fastening material. These are sewn to the ends 46, 48 of the seven inch long piece 40 on one of its sides. Thereafter, two pieces 50, 52, five inches long, are cut from a two inch wide strip of medium weight polypropylene webbing. These two pieces 50, 52, are folded and then sewn to the respective ends 46, 48, of the seven inch long piece 40, on the side opposite to where the hook fastening material pieces 42, 44 have been previously sewn onto the seven inch piece 40. The sewing is undertaken along the collective top positioned edges of both the seven inch piece 40 and the placed together edges of the perpendicularly arranged folded pieces 50, 52. As so positioned and sewn these folded pieces 50, 52 become the respective belt loops 50, 52, and the front portion 34 of the main body 36 is completed.

The rear portion 38 of the main body 36 of the holster 20, is made by cutting one, five inch long piece 54 from a two inch wide strip of heavy weight nylon webbing. The cut ends are singed. Then a five inch long piece 56 is cut from a two inch wide strip of heavy duty nap, i.e. loop, fastening material. Thereafter these five inch long pieces 54 and 56 are sewn together to complete the rear portion 38, which is also referred to as the adjustable portion 38, or the adjuster 38.

After curving both the respective front portion 34 and the rear portion 38, to create the curvable assemblies 30, 32, and moving the front portion ends 46, 48, over the rear portion 38 ends 58, 60 to create a selected overlapping length, the paired ends 46, 58 and 48, 60 are pressed together creating the multiple interlocking fastening of the hook 42, 44 and nap, i.e. loop, 56 materials. This assembly creates the aligned configuration 14 of the hand gun holster, as shown in FIGS. 1 through 4.

The Perpendicular Configuration

The perpendicular configuration 24 shown in FIG. 5 is made in the same way from the same materials, as the alignment configuration 14. However, during the overlapping step, the formerly designated rear portion 38, becomes a bottom portion 62, which is still referred to as the adjustable portion 38, or the adjuster 38. This bottom portion 62 is arranged perpendicularly to the front portion 34 of this new configuration 64 of the main body of the hand gun holster 20 to support a thirty eight revolver 26, as shown in FIG. 5. The selectable amount of overlapping of the hook 42, 44 and nap, i.e. loop 56, materials, determines the supporting size of this perpendicular configuration 24 of the hand gun holster 20.

A Changeable Size Front Supporting Loop

Figure 6:
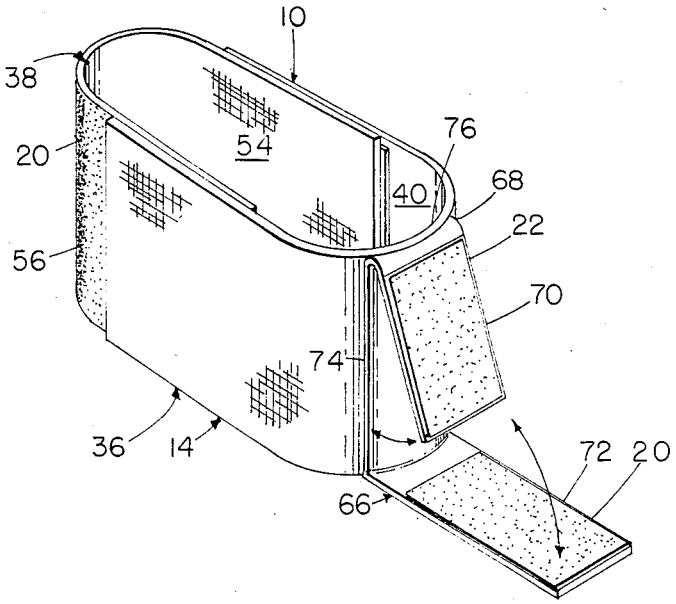
FIG. 6 is a front perspective view of the aligned configuration holster, which utilizes a front openable belt strap, instead of utilizing the two opposite side belt loops.

Primarily for the placement of an automatic pistol 16 inside a person's trousers 28, and especially, when even less bulk is supporting belt loop 66 is sewn onto the front portion 34 of the main body 36, as shown in FIG. 6. Optionally, the side belt loops, one or more, may be added, and optionally the holster 20 may be arranged in either the aligned configuration 14, as shown in FIG. 6, or the perpendicular configuration, as shown in FIG. 5.

This front supporting loop 66 is made by cutting a six and one half inch length 68 of one inch wide webbing of medium weight polypropylene and singeing the cut edges. Then at one end on one side of this six and one half inch webbing 68 a two inch piece 70 of one inch wide hook fastening material is sewn in place. Thereafter, at the other end and on the other side of this six and one half inch webbing 68, a two inch piece 72 of one inch wide nap, i.e. loop, fastening material is sewn in place. Subsequently, this six and one half inch webbing 68, having both the hook material piece 70, and the nap, i.e. loop material piece 72 sewn in place, is then sewn at its middle portion 74 to the central front portion 76 of the front portion 34 of the main body 36 of the hand gun holster 20, as shown in FIG. 6. The selected overlapping distance of the hook material 70 and the nap or loop material 72, determines the adjustable size of this changeable size front supporting belt loop 66.

Regarding Other Possible Sizes, Configurations and Materials

The illustrated embodiments and their descriptions in reference to the presently preferred sizes, materials, and arrangements, are presented as being those now selected to best fulfill the objectives of providing reliable hand gun holsters 20 of less bulk, while retaining the reliability sought by persons who must carry hand guns. In so meeting these objectives, such a person is also presented with an adjustable holster, which may be arranged to carry different sized and/or shaped hand guns, by just pulling apart the overlapping portions of the hook and nap, i.e. loop, materials, and readjusting their overlapping positions, and then pressing them together again to crate the newly sized hand gun holster.

I claim:

1. A hand gun holster selectably configured and to be placed on a belt, either in an alignment configuration to hold an automatic pistol or in a perpendicular configuration to hold a thirty eight revolver, comprising:

(a) a curved front assembly, in turn comprising:

(i) a front curved portion of webbing, having a continuous U shaped front portion, having in turn terminating integral end portions extending rearwardly, having inside facing vertical surfaces;

(ii) hook fastening materials secured to the inside facing vertical surfaces of the rearwardly terminating integral end portions of this front curved portion of webbing, and (iii) two belt loops comprised of folded webbing are secured to the front curved portion of webbing on the terminating integral end portions on the side opposite to the side on which the hook fastening materials are secured;

(b) a curved rear assembly positioned in alignment with the curved front assembly, in turn comprising:

(i) a back curved portion of webbing, having an outside rear facing vertical surface; and (ii) loop fastening material secured to the outside rear facing vertical surface of this back curved portion of webbing, the curved front assembly being aligned with the curved rear assembly, selectively overlapped and then secured together, using the hook and materials, whereby a hand gun holster is completed to receive and to hold an automatic pistol.

2. A hand gun holster selectably configured and to be placed on a belt, as claimed in claim 1, comprising in addition:

a changeable size front openable supporting belt loop secured to the front portion of the front curved portion of webbing and being openable and adjustable in size by having hook and loop materials secured to the respective ends of this openable supporting belt loop.

3. A hand gun holster selectably configured and to be placed on a belt to hold a thirty eight revolver, comprising:

(a) a curved front assembly, in turn comprising:

(i) a front curved portion of webbing, having a continuous U shaped front portion, having in turn terminating integral end portions extending rearwardly, having inside facing vertical surfaces;

(ii) hook fastening materials secured to the inside facing vertical surfaces of the rearwardly terminating integral end portions of this front curved portion of webbing, and (iii) at least one belt loop of webbing folded and secured to the front curved portion of the webbing on one of the terminating integral end portions on the outside opposite to the inside facing vertical surface on which the hook fastening materials are secured;

(b) a curved bottom assembly in turn comprising:

(i) a curved bottom portion of webbing;

(ii) loop fastening material secured to the outside bottom facing horizontal surface of this curved bottom portion of webbing, the curved front assembly being aligned with the curved bottom assembly, selectively overlapped and then secured together, using the hook and loop materials, whereby a hand gun holster is completed to receive and to hold a thirty eight revolver or other hand gun.

4. A hand gun holster selectably configured and to be placed on a belt, as claimed in claim 3, comprising, in addition:

a changeable size front openable supporting belt loop secured to the front portion of the front curved portion of the webbing and being openable and adjustable in size by having hook and loop materials secured to the respective ends of this openable supporting belt loop.

5. A hand gun holster selectably configured to hold a thirty eight revolver, comprising:

(a) a curved front assembly, in turn comprising:

(i) a front curved portion of webbing, having a continuous U shaped front portion, having in turn terminating integral end portions extending rearwardly, having inside facing vertical surfaces;

(ii) hook fastening materials secured to the inside facing vertical surfaces of the rearwardly terminating integral end portions of this front portion of webbing;

(b) a curved bottom assembly in turn comprising:

(i) a curved bottom portion of webbing;

(ii) loop fastening material secured to the outside bottom facing horizontal surface of this bottom curved portion of webbing;

said front and bottom assemblies being selectively overlapped and then secured together, using the hook and loop materials, whereby a hand gun holster is completed to receive and to hold a thirty eight revolver or other hand gun;

a changeable size front openable supporting belt loop secured to the front portion of the front curved portion of the webbing and being openable and adjustable in size by having hook and loop materials secured to the respective ends of this openable supporting belt loop.

6. A hand gun holster selectably configured to hold an automatic pistol, comprising:

(a) a curved front assembly, in turn comprising:

(i) a front curved portion of webbing, having a continuous U shaped front portion, having in turn terminating integral end portions extending rearwardly, having inside facing vertical surfaces; and (ii) hook fastening materials secured to the inside facing vertical surfaces of the rearwardly terminating integral end portions of this curved front portion of webbing.

(b) a curved rear assembly positioned in alignment with the curved front assembly, in turn comprising:

(i) a back or curved portion of webbing, having an outside rear facing vertical surface;

(ii) loop fastening material secured to the outside rear facing vertical surface of this back curved portion of webbing;

said curved front assembly being aligned with the curved rear assembly, and these assemblies are selectively overlapped and then secured together, using the hook and loop materials, whereby a hand gun holster is completed to receive and to hold an automatic pistol; and changeable size front openable supporting belt loop secured to the front portion of the front curved portion of webbing and being openable and adjustable in size by having hook and loop materials secured to the respective ends of this openable supporting belt loop.

* * * * *